US007931798B2

(12) United States Patent
Gorbaty et al.

(10) Patent No.: US 7,931,798 B2
(45) **Date of Patent: *Apr. 26, 2011**

(54) HYDROCONVERSION PROCESS FOR PETROLEUM RESIDS BY HYDROCONVERSION OVER CARBON SUPPORTED METAL CATALYST FOLLOWED BY SELECTIVE MEMBRANE SEPARATION

(75) Inventors: Martin L. Gorbaty, Westfield, NJ (US); David T. Ferrughelli, Flemington, NJ (US); Edward W. Corcoran, Easton, PA (US); Stephen M. Cundy, Lebanon, NJ (US); Andrew Kaldor, Warren, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 154 days.

This patent is subject to a terminal disclaimer.

(21) Appl. No.: 12/073,843

(22) Filed: Mar. 11, 2008

(65) Prior Publication Data

US 2009/0234166 A1 Sep. 17, 2009

(51) Int. Cl.
*C10G 47/02* (2006.01)
*C07C 7/144* (2006.01)

(52) U.S. Cl. ..... 208/112; 208/142; 208/113; 208/121; 208/123; 208/124; 208/133; 210/650; 210/651; 210/652; 210/653; 210/654; 210/655; 585/818

(58) Field of Classification Search ..... 208/112–113, 208/121, 123, 124, 133–134, 136–137, 142–145; 210/650–655; 585/818
See application file for complete search history.

(56) References Cited

U.S. PATENT DOCUMENTS

| | | | | |
|---|---|---|---|---|
| 3,673,112 | A * | 6/1972 | Levinson | 208/112 |
| 4,134,825 | A | 1/1979 | Bearden, Jr. et al. | |
| 4,200,519 | A * | 4/1980 | Kwant et al. | 208/106 |
| 4,226,742 | A | 10/1980 | Bearden, Jr. et al. | |
| 4,244,839 | A | 1/1981 | Aldridge et al. | |
| 4,548,700 | A | 10/1985 | Bearden, Jr. et al. | |
| 4,591,578 | A | 5/1986 | Foley et al. | |
| 4,626,340 | A * | 12/1986 | Galiasso et al. | 208/112 |
| 4,740,489 | A * | 4/1988 | Bearden et al. | 502/150 |
| 4,797,200 | A * | 1/1989 | Osterhuber | 208/308 |
| 4,882,036 | A * | 11/1989 | Eidt et al. | 208/50 |
| 5,039,392 | A * | 8/1991 | Bearden et al. | 208/216 R |
| 5,961,815 | A * | 10/1999 | Hickey et al. | 208/108 |
| 6,264,828 | B1 | 7/2001 | Baker et al. | |
| 6,896,796 | B2 | 5/2005 | White et al. | |
| 2002/0040863 | A1 * | 4/2002 | Cody et al. | 208/18 |
| 2004/0211706 | A1 | 10/2004 | White et al. | |
| 2005/0005374 | A1 | 1/2005 | Weber et al. | |
| 2009/0057192 | A1 | 3/2009 | Leta et al. | |
| 2009/0057196 | A1 | 3/2009 | Leta et al. | |
| 2009/0057198 | A1 | 3/2009 | Leta et al. | |
| 2009/0057200 | A1 | 3/2009 | Leta et al. | |
| 2009/0057203 | A1 | 3/2009 | Leta et al. | |
| 2009/0057226 | A1 * | 3/2009 | Leta et al. | 210/651 |
| 2009/0062590 | A1 | 3/2009 | Nadler et al. | |
| 2009/0230022 | A1 * | 9/2009 | Gorbaty et al. | 208/112 |

OTHER PUBLICATIONS

Masato Kouzu et al., "Catalytic Hydrocracking of Petroleum Residue over Carbon-Supported Nickel-Molybdenum Sulfides", Energy Fuels, 19 (3), 725-730 (2005) (Abstract).

* cited by examiner

*Primary Examiner* — Glenn A Caldarola
*Assistant Examiner* — Michelle L Stein
(74) *Attorney, Agent, or Firm* — Malcolm D. Keen; Glenn T. Barrett

(57) ABSTRACT

A heavy residual petroleum feed boiling above 650° F.+ (345° C.+) is subjected to hydroconversion at elevated temperature in the presence of hydrogen at a hydrogen pressure not normally higher than 500 psig (3500 kPag) using a dispersed metal-on-carbon catalyst to produce a hydroconverted effluent which is fractionated to form a low boiling fraction and a relatively higher boiling fraction which is subjected to membrane separation to produce a permeate which is low in metals and Microcarbon Residue (MCR) as well as a retentate, containing most of the MCR and metals. The process has the advantage that the hydroconversion may be carried out in low pressure equipment with a low hydrogen consumption as saturation of aromatics is reduced.

20 Claims, No Drawings

HYDROCONVERSION PROCESS FOR PETROLEUM RESIDS BY HYDROCONVERSION OVER CARBON SUPPORTED METAL CATALYST FOLLOWED BY SELECTIVE MEMBRANE SEPARATION

FIELD OF THE INVENTION

This invention relates to a process for converting a heavy hydrocarbonaceous feedstock to lower boiling products using a combination of hydroconversion over a carbon-supported metal catalyst followed by selective membrane separation.

BACKGROUND OF THE INVENTION

As the use of low quality refinery feedstocks has increased, a concomitant need for improved resid processing capacity has accompanied it as these feeds generally result in larger quantities of residual fractions in the refinery. At the same time, the long term needs to cut costs and to make cleaner products represent conflicting requirements. Feed accounts for about 70% of the refining costs and the use of less expensive feeds would cut costs. However less expensive feeds typically have higher sulfur, metals, and aromatics which make them more costly to process. Thus, in order to meet the objective of reducing costs the heavier refinery fractions which contain the bulk of the sulfur, metals and aromatics, must be processed more efficiently into the more valuable lower boiling fractions such as gasoline and distillate.

One of the many types of processes developed for the treatment of residual feeds is the hydroconversion of heavy residual feedstocks in a slurry process using a catalyst prepared in a hydrocarbon oil from a thermally decomposable metal compound catalyst precursor. The catalyst may be formed in situ in the hydroconversion zone or separately as described, for example, in U.S. Pat. Nos. 4,134,825; 4,226,742; 4,244,839; 4,740,489 and 5,039,392 which describe processes of this type using catalysts based on the metals of Groups IVB, VB, VIB, VIIB and VIII of the CAS Periodic Table (i.e., Groups 4-10 in the IUPAC Periodic Table (2004)), preferably from Groups VB, VIB and VIII (i.e., Groups 5, 6 and 8 through 10 in the IUPAC Periodic Table (2004)).

In this process it is possible to use hydrogen pressures which are far lower than the 1500-3000 psig (about 10,000-21,000 kPag) used in conventional hydroprocessing techniques. At these lower pressures, typically as low as 250 psig (about 1725 kPag), a substantial proportion, typically up to 65%, of 650° F.$^+$ (345° C.+) resid molecules can be converted to lower boiling range products (e.g., 650° F.$^-$ (345° C.−) fractions) using a few hundred parts per million of a dispersed metal on carbon catalyst, at 450° C. (about 840° F.). The small amount of catalyst is enough to maintain coke at a manageable level and the hydrogen pressure is low enough that aromatic rings are not saturated so there is low hydrogen consumption. A significant portion of the feed is converted to lower boiling range products, e.g. products which can be treated as in the 650° F.$^-$ (345° C.−) boiling range, which are high in saturated (aliphatic) molecules. The higher boiling range portion of the reaction products (e.g., 650° F.$^+$ (345° C.+) portion), can then be treated in separate processing in a way which utilizes the favorable characteristics of the hydroconversion products.

SUMMARY OF THE INVENTION

In the process according to the present invention, the heavy ends from a low pressure hydroconversion process using the dispersed metal-on-carbon catalysts are subsequently processed by selective membrane separation to produce a permeate which is low in metals and Microcarbon Residue (MCR) precursors as well as a retentate, containing most of the MCR precursors and metals from the feed. The permeate, being low in metals and carbon residue, may be further processed in a fluidized catalytic cracker (FCC); the retentate with its higher metals and carbon residue content may be further converted to liquids by a typical thermal process such as delayed coking or a fluid coking process such as the ExxonMobil Flexicoking™ process.

More particularly, according to the present invention, a heavy residual petroleum feed typically boiling above 650° F.$^+$ (345° C.+), is subjected to conversion at elevated temperature in the presence of hydrogen at a hydrogen pressure not higher than 500 psig (3500 kPag) using a dispersed metal-on-carbon catalyst to produce a hydroprocessed effluent comprising a high boiling fraction and a relatively lower boiling fraction. Generally, the lower boiling fraction will be a fraction which boils no higher than 650° F./345° C. and the higher boiling fraction will be one which boils no lower than 650° F./345° C. The higher boiling fraction is subjected to membrane separation to produce a permeate which is low in metals and Microcarbon Residue (MCR) precursors as well as a retentate, containing most of the MCR precursors and metals. Advantages of using the low hydrogen pressure hydroconversion are that (1) a significant portion of the resid can be converted to naphtha and distillate, which are almost identical to virgin naphtha and distillate, without the consumption of large amounts of hydrogen, (2) there is less capital investment cost since the low hydrogen pressure needed for the conversion can be achieved with thin walls of standard metallurgy rather than thick walls of standard or exotic alloys and (3) capital and operating costs for compression of hydrogen at lower pressure are significantly reduced. The membrane separation, in turn, requires lower investment and operating costs relative to vacuum distillation for the heavy ends.

DETAILED DESCRIPTION

According to the present invention, a process for residuum conversion uses low hydrogen pressures to effect an initial conversion to higher quality naphtha and middle distillate products which are high in saturates. The heavy ends from the hydroconversion process are then processed by membrane separation to form a low metals/low carbon residue permeate which is suitable for use as FCC feed and a higher metals/residual carbon retentate which can be subjected to thermal processing to produce more liquid product.

The feed for the initial hydroconversion step is a heavy oil feed, typically with an MCR value of at least 3%. Feeds of this type are normally residual fractions such as atmospheric and vacuum resids obtained from the distillation of crude oils and topped crudes but other fractions which are amenable to processing by the present procedure include high boiling fractions such as cycle oils, extracts or coker heavy gas oil. Feeds of this type generally have a boiling point of at least 650° F. (about 345° C.) or higher, for example, 900° F. (about 480° C.) or even above about 1000° F. (about 540° C.).

This initial hydroconversion step on the heavy oil feed is characterized by its use of a dispersed metal-on-carbon catalyst at low hydrogen pressures below 500 psig/3,500 kPag, typically below about 250 psig (1725 kPag). Temperatures used in this step are quite high for hydroconversion, typically from 650° F./345° C. or higher and usually at least 770° F./410° C. with a normal maximum of 890° F./475° C.; in most cases the temperature will be in the range of 800°

F./425° C. to 850° F./450° C. It has been found that the use of low hydrogen pressures in this step is important for the preferential production of liquid product; if pressures are increased to the level conventionally used in hydroprocessing, for example, about 7,000 kPag (1,000 psig), the proportion of liquid product from this step of the processing decreases markedly.

The hydroconversion is carried out in the presence of a dispersed metal-on-carbon catalyst. These catalysts may be made in different ways, including in-situ decomposition of a soluble or dispersible inorganic or organic compound of the catalytic metal in oil or alternatively, by the addition of a dispersible, pre-formed metal-on-carbon catalyst to the heavy oil feed. The metals used in these catalysts are the transition metals which possess hydrogenation activity and therefore will be selected from Groups IVB, VB, VIB, VIIB and VIII of the CAS Periodic Table (i.e., Groups 4-10 in the IUPAC Periodic Table (2004)), preferably from Groups VB, VIB and VIII (Groups 5, 6 and 8 through 10 in the IUPAC Periodic Table (2004)). Thus, dispersed metal-on-carbon catalysts using titanium, zirconium, vanadium, niobium, tantalum, chromium, molybdenum, tungsten, manganese, rhenium, iron, cobalt, nickel as well as the noble metals platinum, palladium osmium, ruthenium, and rhodium may be the catalytic metals in such catalysts. Normally, however, the metal will be a base metal selected from vanadium, chromium, molybdenum, tungsten, cobalt or nickel although the noble metals platinum and palladium also possess hydrogenation capability. The preferred metal is molybdenum and accordingly, these catalysts will be referred to for convenience as molybdenum-on-carbon catalysts and their preparation described with reference to molybdenum as the active metal component.

These catalysts may be prepared, in general terms, by converting an oil soluble compound of the catalytic metal while in solution in an oil which contains microcarbon precursors (typically with an MCR of 3 wt. pct. or more) to form particles of catalytic metal component dispersed on carbon particles; the conversion is effected by treatment with a hydrogen-containing gas, preferably hydrogen or a mixture of hydrogen and hydrogen sulfide, at elevated temperature. Oils which conform to this requirement are generally classified as residual fractions themselves; both atmospheric resids and vacuum resids will be suitable subject to the microcarbon residue content. The metal component on the catalyst is believed to be present in the sulfide form since the use of hydrogen sulfide in the catalyst formation has been found to give good results in terms of catalytic activity; its use however, is not conceived as indispensable since degradation of sulfur compounds in the oil at elevated temperatures, e.g. above about 350° C. (about 660° F.), in the presence of hydrogen and the metal compound may be sufficient to deposit the metal as sulfide on the carbon support. The use of hydrogen sulfide is particularly preferable with oils which contain relatively low levels of sulfur and is generally to be recommended in order to ensure that the metal is present in the sulfide from in the dispersed catalyst. Suitable oil soluble compounds which are convertible to dispersed catalysts include inorganic compounds of the metals, especially heteropoly acids such as phosphomolybdic acid, molybdosilicic acid, salts of the metals with organic acids such as alicyclic and acyclic carboxylic acids containing two or more carbon atoms (e.g., naphthenic acids), salts of aromatic carboxylic acids such as toluic acid, salts of sulfonic acids (e.g., toluene sulfonic acid and sulfinic acids), mercaptides, xanthates, metal salts of phenols, and polyhydroxyaromtics, as well as organometallic compounds such as metal chelates (e.g., with 1,3-diketones, ethylenediamine, ethylenediamine tetraacetic acid, phthalocyanines and metal derivatives of organic amines such as aliphatic amines, aromatic amines and quaternary ammonium compounds). The metal compound may be dissolved in water which is later removed at the elevated temperature used for the conversion. The reaction of the metal compound and the microcarbon residue precursors in the oil results in a catalytically active metal sulfide-on-carbon dispersion. This dispersion may be used as such or the dispersed catalyst particles may be separated and used with a different oil feed. Normally, however, since the oil which is to be treated is a resid, that is, an oil which contains microcarbon precursors, typically with an MCR of at least 3 wt percent, it suffices to generate the catalyst in situ in the resid feed, obviating the need for separation. Suitable exemplary methods for the preparation of these catalysts are found in U.S. Pat. Nos. 4,134,825; 4,226,742; 4,244,839; 4,740,489 and 5,039,392, to which reference is made for a description of such techniques.

A preferred technique is to prepare the catalyst as a dispersion in the heavy oil feed which is to be processed in the hydroconversion by decomposing the metal (e.g., molybdenum), compound under heat in the presence of hydrogen, preferably a mixture of hydrogen and hydrogen sulfide. This oil dispersion of the catalyst may then be conveniently added directly to the feedstream in the required amount before the feedstream enters the hydroconversion reactor. Thermal decomposition temperatures in the range of at least 200° C., generally from 200 to 500° C. are in general useful with temperatures in the range of 300-400° C. preferred. Preferred catalysts are molybdenum based and will normally contain from 20 to 30 wt. pct. of molybdenum. If other catalytic metals are used, the amount will vary depending on the activity of the metal in the catalyst. The amount of metal on the catalyst will depend in part on the MCR value of the oil in which the catalyst is generated: higher microcarbon residue (MCR) values for the oil will lead to relatively lower metal contents in the final catalyst. For example, generation of a molybdenum-on-carbon catalyst in an oil with an MCR of about 10 percent may be expected to result in a catalyst with 25-30% of metal as metal sulfide on the carbon but use of an oil with an MCR value of about 20 percent would be expected to result in a catalyst with a relatively lower content of the metal sulfide. In this way, the metal content of the catalyst may be controlled by use of the appropriate oil. The activity of the catalysts is usually enhanced by carrying out the decomposition in the presence of hydrogen sulfide to ensure the production of a sulfided catalyst product.

The amount of catalyst used will depend on the feed type and the hydrogen pressure as well as the acceptable level of the toluene insolubles tolerated by the process but the process using these dispersed metal catalysts is notable for the very small catalytic amounts that may be employed. The amount of catalyst is typically from about 100-5,000 ppmw relative to the weight of the heavy oil feed and in most cases from 100-2000 ppmw, preferably from 250-1,000 ppmw, relative to feed, and is calculated based on the weight of the metal in the catalyst.

The hydroconversion proceeds by a dealkylation mechanism in which long chain alkyl groups on the resid feed are hydrogenatively split off aromatic nuclei to form low boiling (typically 650° F.–/3435° C.–) liquids which are predominantly saturated, normally containing 75-85% saturated molecules with the remaining 15-25% aromatic molecules being mostly single ring aromatics. Since the hydroconversion is typically carried out at a relatively high temperature for a hydrogenative process, the relatively lower boiling liquid fraction will pass out of the reactor as an off-gas and can be condensed to form the resulting liquid. The lower boiling liquid fractions (e.g. 650° F.⁻/345° C.–) produced from this process will, in general, have almost the identical properties (e.g., boiling points, compositions) of virgin naphthas and distillates produced from virgin crudes with the exception that the N and S levels will be slightly higher.

The remaining portion of the hydroconversion reaction product stream (typically a 650° F.⁺/345° C.+ fraction) may be further separated using membrane technology. A variety of membrane materials may be considered for such a separation, including molecular weight cutoff polymer membrane systems, surface-functionalized polymers, polymer membranes with inherent voids in their structure, polymer membranes containing entrained inorganics, carbon membranes, and numerous inorganic membrane systems. Typical polymer membrane materials which may be used when produced with the requisite porosity include polyimides, polycarbonates, poly(acrylonitrile-co-methacrylic acid) and expanded poly (tetrafluoroethylene). The class of inorganic membranes contains a multitude of compositions (e.g., alumina, silica, titania, zirconia, and many composites of these oxides, as well as zeolites) ranging from microfiltration capabilities to ultra- or nanofiltration systems. Pervaporation membranes may also find application in this process. Depending upon the feed and the selected membrane, the degree of separation of the low metals/MCR permeate and the high metals/MCR retentate may be determined empirically in accordance with known parameters and correlations for such systems. Permeability of the membrane will also need to be determined on an empirical basis since the molecular dimensions of the feed molecules will vary according to the composition of the feed to the separation step. In general, permeabilities in the order of 50 to 50,000 Gurley seconds are useful for most feeds with values of approximately 1,000 to 10,000 Gurley seconds (e.g., about 5,000 Gurley seconds), being the normal order for useful membranes.

The membrane system can be engineered in several different feed configurations, such as 'batch' feed to the system, or crossflow feed, where the feed is recycled over the front side of the membrane. Likewise the membrane can be 'dead-ended' where the permeate collects on the backside of the barrier, or a permeate sweep can be utilized. These configurations, and the process conditions where the system is operated, can dramatically affect membrane performance.

The high boiling fraction from the hydroconversion is contacted in either batch mode, or in feed recycle configuration with the front side of the separation membrane, at ambient to elevated temperatures (room temperature to 500° C., normally not more than 200° C. and in most cases not more than 100° C.), and moderate to high feed pressures (200 to 21,000 kPag/about 30 to 3000 psig). The use of higher pressures has been found to be favorable to the properties of the permeate in that the micro carbon residue and metals contents (mainly, nickel and vanadium) are lower at high pressures. It is hypothesized that under pressure over a porous membrane material, the polar constituents of a heavy hydrocarbon liquid mixture tend to associate, forming a layer of aggregated polar material (over or at the membrane surface), which, in turn, serve to reject polars and other large molecules, but pass more linear and smaller molecules such as saturates. As the pressure increases, the efficacy of this layer appears to increase further restricting passage of polars with a net increase of efficiency (i.e. rejecting MCR precursors and metals with greater efficiency). When the feed pressure is removed, the layer tends to disassociate, returning to a homogenous mixture of heavy hydrocarbons. While batch operations are simpler, feed recycle can sometimes maintain higher fluxes in operation by reducing membrane fouling at the surface; selectivities can also potentially improve in this configuration by reducing local concentration gradients of the feed at the membrane surface during operation.

Membrane performance can sometimes be improved during operation by removal of the membrane for cleaning, or through in situ performance regeneration procedures (e.g., backflushing).

Permeate from the membrane separation may be collected by gravity flow, or can be swept away from the backside of the membrane using a compatible sweep. This latter mode of operation can sometimes improve membrane performance by reducing a buildup of permeate on the backside membrane surface.

The membrane permeate from the relatively higher boiling stream contains only low levels of MCR and metals and can be sent to FCC as a blend with conventional VGO or optionally sent to a feed hydrotreater before going to the FCC in order to reduce sulfur and nitrogen. The retentate, containing most of the MCR and metals can be sent to a thermal processing step (e.g., delayed coker or fluid coker such as a Flexicoker), for further conversion in low boiling liquid products.

The Microcarbon Residue (MCR) is determined by test method ASTM D4530, Standard Test Method for Determination of Carbon Residue (Micro Method).

EXAMPLE 1

Catalyst Preparation.

A catalyst was prepared by decomposing a dispersion of phosphomolybdic acid (PMA) in Arabian Light Atmospheric Resid (ALAR) in the presence of hydrogen and $H_2S$ and filtering it from the oil. An autoclave was charged with 100 g of ALAR and the PMA dispersed in the oil was added. The autoclave was heated to 150° C., after which the autoclave was charged to 100 psig (690 kPag) with $H_2S$ while being stirred and held at temperature for 30 min. The autoclave was then flushed with hydrogen and heated to 280° C. under 1000 psig (7,000 kPag) of static hydrogen. Hydrogen flow was started at 0.45 l/min as the autoclave was heated to 390° C. and held at these conditions for one hour. After cooling to 150° C. the reactor was vented and the contents filtered and washed with toluene to remove residual oil.

EXAMPLE 2

General Conversion Procedure

A 300 cc autoclave was charged with 100-150 g of residuum feed stock and the appropriate amount of catalyst, chosen on the basis of weight of catalyst metal relative to feed, was added. The autoclave was flushed out with hydrogen and heated to 280° C. under static hydrogen pressure. Hydrogen flow of 0.45 l/min was started at this time to ensure that hydrogen starvation did not occur during the run. The hydrogen pressure, final temperature and time (run severity) were chosen to achieve the extent of conversion desired. The mixture was stirred during reaction to ensure adequate mass transfer of hydrogen. Lighter liquids produced as off-gas during the run were collected in a chilled knockout vessel downstream of the autoclave. After the specific reaction time at temperature had been achieved, the autoclave was cooled to 270° C. then purged with hydrogen gas for 30 minutes to remove any lighter liquids remaining in the reactor. Gas produced during the run was collected in a gas collection bag situated downstream of the knockout vessel. The oil remaining in the autoclave, the knockout liquids and the gas products were analyzed to determine yields and qualities. After the 30 minute purge, the residual oil was cooled to about 200° C. and filtered to remove the catalyst and any toluene insolubles (coke) produced.

EXAMPLE 3

Liquid Yield Relation to Hydrogen Pressure.

The procedures of Examples 1 and 2 were followed to produce the data shown in Table 1 for both ALAR and Arabian Light Vacuum Residuum (ALVR). Hydrogen pressure was varied from 250-1000 psig (1725-7,000 kPag) to illustrate the effect on gas/liquid yields and the amount of toluene insolubles produced. The liquid yields referred to in Table 1 below are the yields of the light (650° F.–/345° C.–) liquids collected in the knockout vessel.

TABLE 1

Hydroconversion Liquid Yield.

| Feed | Catalyst, Mo ppm | Temp., ° C. | Severity[a] | H2 Press., psig/kPag | Liquids, Wt % | Gas, Wt. % | Coke, Wt. % |
|---|---|---|---|---|---|---|---|
| ALAR | 250 | 425 | 2× | 250/1725 | 32 | 4.4 | 1.2 |
| ALAR | 250 | 425 | 2× | 1000/7000 | 20 | 6 | 0.5 |
| ALAR | 1000 | 450 | 4× | 250/1725 | 47 | 6 | 2.1 |
| ALAR | 1000 | 450 | 4× | 1000/7000 | 32 | 7.8 | 0.7 |
| ALVR | 250 | 425 | 2× | 250/1725 | 26 | 5 | 4.9 |
| ALVR | 250 | 425 | 2× | 1000/7000 | 14 | 4 | 1.3 |

Note:

[a]One time severity is defined as 120 min. at 411° C. Severities at other temperatures are corrected using a 53 kcal/mole activation energy.

Data from the conversion of both the atmospheric and vacuum residua show that more light (650° F.⁻/345° C.⁻) liquids are produced at the lower hydrogen pressure in all cases. In the atmospheric residua cases (ALAR), coke levels rise when converted at 250 psig/1725 kPag but only slightly. The coke increases more rapidly in the vacuum resid case (ALVR) when converted at 250 psig/1725 kPag.

EXAMPLE 4

Membrane Separation of 650° F.⁺/345° C.+ Product into FCC and Coking Feeds

The Arabian Light Atmospheric Residuum was subjected to hydroconversion at 425° C. and 3500 kPag/500 psig H2 for 94 minutes with 250 ppm Mo catalyst. A 650° F.+/345° C.+ fraction collected from the hydroconverted oil (11.3 wt % MCR; 10.0 ppm Ni; 34.0 ppm V) was contacted, in batch mode, with an as-received, small pore, 5000 Gurley-sec expanded PTFE (ePTFE) membrane from W.L. Gore and Associates, at elevated pressure and temperature (93° C., 100 psig/700 kPag) feed pressure established using pressurized front side nitrogen). At these conditions, reasonable selectivities for MCR and metals (i.e. high rejection rates) were observed during several hours of operation. The feed pressure was then raised to 400 psig/2760 kPag, realizing only a modest increase in MCR rejection. Feed pressures were then raised to 700 psig/4825 kPag, where optimum performance was observed—the ePTFE membrane produced permeates with 2.9 wt % MCR, 2.0 ppm Ni, and 4.5 ppm V. This performance was stable for the length of the experiment (46 hours). Data from this test are shown in Table 2 below.

TABLE 2

Reduction in MCR and metals in permeate

| Pressure, kPag | Permeate MCR, wt. % | Permeate Ni, ppm | Permeate V, ppm, | Reduction, % MCR | Reduction, % Ni | Reduction, % V | Flow Rate, Final, l/hr. |
|---|---|---|---|---|---|---|---|
| 700 | 8.15 | 6.00 | 20.00 | 27.9 | 40.00 | 41.18 | 4.5 |
| 700* | 4.72 | 2.50 | 7.00 | 58.28 | 75.00 | 79.41 | 3.4 |
| 2760* | 4.33 | 2.50 | 8.00 | 61.69 | 75.00 | 76.47 | 4.1 |
| 4825* | 2.92 | 2.00 | 4.50 | 74.15 | 80.00 | 86.76 | 2.5 |

• Values in these determinations are uncorrected for concentration changes in feed as a function of time.

| Final Retentate Concentrations: | |
|---|---|
| MCR, wt % | 15.43 |
| Ni, ppm | 15.00 |
| V, ppm | 50.00 |

The invention claimed is:

1. A process for the conversion of a residual petroleum feed with low hydrogen consumption, which comprises:

subjecting a heavy petroleum feed consisting of an atmospheric resid or a vacuum resid, which feed has an initial boiling point of at least 345° C. to hydroconversion at elevated temperature in the presence of hydrogen at a hydrogen pressure not higher than 3500 kPag in the presence of a dispersed metal-on-carbon catalyst to produce a hydroconverted effluent comprising a first 345° C. – fraction and a second fraction boiling above the boiling range of the first fraction; forming a feed consisting of the second fraction for a membrane separation step and separating the second fraction by the membrane separation step to produce a permeate and a retentate, the permeate being is lower in metals and Microcarbon Residue (MCR) relative to the retentate.

2. A process according to claim 1 in which the residual petroleum feed has a Microcarbon Residue of at least 3 wt percent.

3. A process according to claim 1 in which the hydroconversion step is carried out at a hydrogen pressure of not more than 1725 kPag.

4. A process according to claim 1 in which the hydroconversion step is carried out at a temperature of 410° C. to 450° C.

5. A process according to claim 1 in which the amount of dispersed metal-on-carbon catalyst in the hydroconversion is from 100-2000 ppmw calculated as metal, relative to feed.

6. A process according to claim 1 in which the metal of the dispersed metal-on-carbon catalyst comprises a metal of Groups 5, 6, and 8 through 10 in the IUPAC Periodic Table (2004).

7. A process according to claim 6 in which the metal of the dispersed metal-on-carbon catalyst comprises molybdenum.

8. A process according to claim 1 in which the feed consisting of the second fraction is separated in the membrane separation step using a membrane having a permeability of 1,000 to 10,000 Gurley seconds.

9. A process according to claim 1 in which the permeate separated in the membrane separation step is subjected to a fluid catalytic cracking step.

10. A process according to claim 1 in which the retentate separated in the membrane separation step is subjected to a thermal cracking step.

11. A process according to claim 1 in which the hydroconverted effluent first 345° C.– fraction comprises a 345° C.– hydrocarbon fraction of 75 to 85 percent saturates and 15 to 25 percent aromatics.

12. A process according to claim 1 in which the molybdenum-on-carbon catalyst comprises from 20 to 30 weight percent molybdenum.

13. A process according to claim 1 in which the permeate of the membrane separation step has a MCR (ASTM D4530) of not more than 8 weight percent.

14. A process according to claim 1 in which the dispersed metal catalyst comprises a dispersed metal sulfide catalyst produced by the conversion of an oil-soluble compound of a metal of Groups 4 through 10 in the IUPAC Periodic Table (2004) in the presence of a hydrogen-containing gas at elevated temperature.

15. A process according to claim 14 in which the metal of the dispersed metal-on-carbon catalyst comprises a metal of Groups 5, 6 or 8 through 10 in the IUPAC Periodic Table (2004).

16. A process according to claim 15 in which the metal of the dispersed metal-on-carbon catalyst comprises molybdenum.

17. A process according to claim 14 in which the dispersed catalyst is produced by the conversion of an oil-soluble compound of a metal of Groups 4 through 10 in the IUPAC Periodic Table (2004) in the presence of hydrogen and hydrogen sulfide.

18. A process according to claim 15 in which the hydroconversion step is carried out at a hydrogen pressure of not more than 1725 kPag and a temperature of 410° C. to 450° C.

19. A process according to claim 15 in which the amount of dispersed metal-on-carbon catalyst in the hydroconversion is from 100-2000 ppmw metal, relative to feed.

20. A process according to claim 14 in which the feed consisting of the second fraction is separated in the membrane separation step using a membrane having a permeability of 1,000 to 10,000 Gurley seconds.

* * * * *